United States Patent [19]

Lindsay

[11] 3,955,328

[45] May 11, 1976

[54] MODULAR BUILDING SYSTEM

[76] Inventor: Jeffrey Lindsay, 420 Amapola Lane, Los Angeles, Calif. 90024

[22] Filed: Jan. 25, 1974

[21] Appl. No.: 436,733

Related U.S. Application Data

[63] Continuation-in-part of Ser. No. 142,219, May 11, 1971, abandoned.

[52] U.S. Cl. ..... 52/73; 52/79; 52/81; 52/237; 52/DIG. 10

[51] Int. Cl.[2] ..... E04B 1/32; E04B 5/43

[58] Field of Search ..... 52/73, 79, 236, 237, 52/81, DIG. 10

[56] References Cited

UNITED STATES PATENTS

| | | | |
|---|---|---|---|
| 2,841,832 | 7/1958 | Coase | 52/79 |
| 3,468,083 | 9/1969 | Camoletti | 52/237 |
| 3,566,554 | 3/1971 | Schaffer | 52/79 |
| 3,618,273 | 11/1971 | Crandall | 52/80 |
| 3,690,077 | 9/1972 | Dalgliesh | 52/79 |
| 3,769,766 | 1/1973 | Speidel | 52/73 |
| 3,790,657 | 2/1974 | Leonte | 52/227 |
| 3,813,835 | 6/1974 | Rice | 52/79 |

FOREIGN PATENTS OR APPLICATIONS

| | | | |
|---|---|---|---|
| 715,643 | 10/1966 | Italy | 52/73 |
| 1,269,321 | 7/1961 | France | 52/79 |
| 200,052 | 5/1920 | Canada | 52/237 |

*Primary Examiner*—Frank L. Abbott
*Assistant Examiner*—Henry Raduazo
*Attorney, Agent, or Firm*—I. Morley Drucker

[57] ABSTRACT

The modular building system of this invention relates generally, but not exclusively, to habitations. The system comprises at least two individual room or space modules which are individually secured to their foundations and at least one additional individual room or space module which structurally spans between and interconnects at least two of the aforementioned foundation secured modules.

In the preferred embodiment of this invention, the enclosing shells of the modules are comprised of a plurality of prefabricated sections, the shapes of which are derived from the geometry of a spherical square. A great variety of floor plan arrangements can be realized within the scope of the invention by interconnecting individual room or space modules, either laterally or vertically into various groupings, any one of which comprises one particular building.

11 Claims, 8 Drawing Figures

Fig. 6.
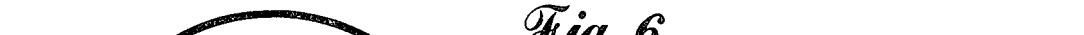
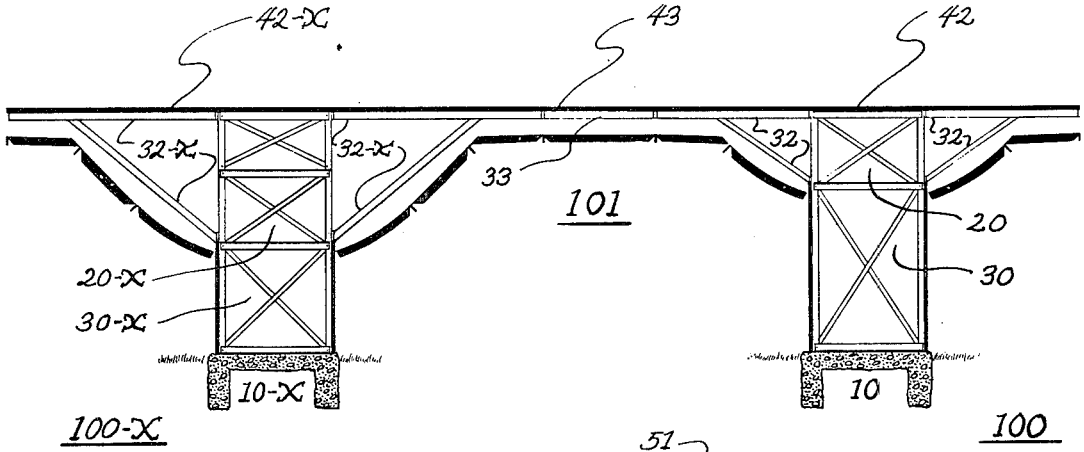
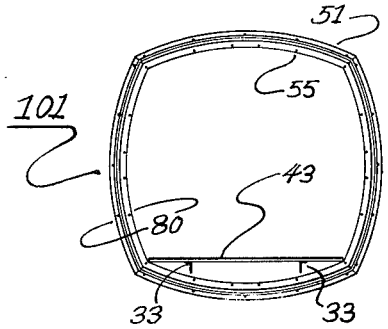
Fig. 7.
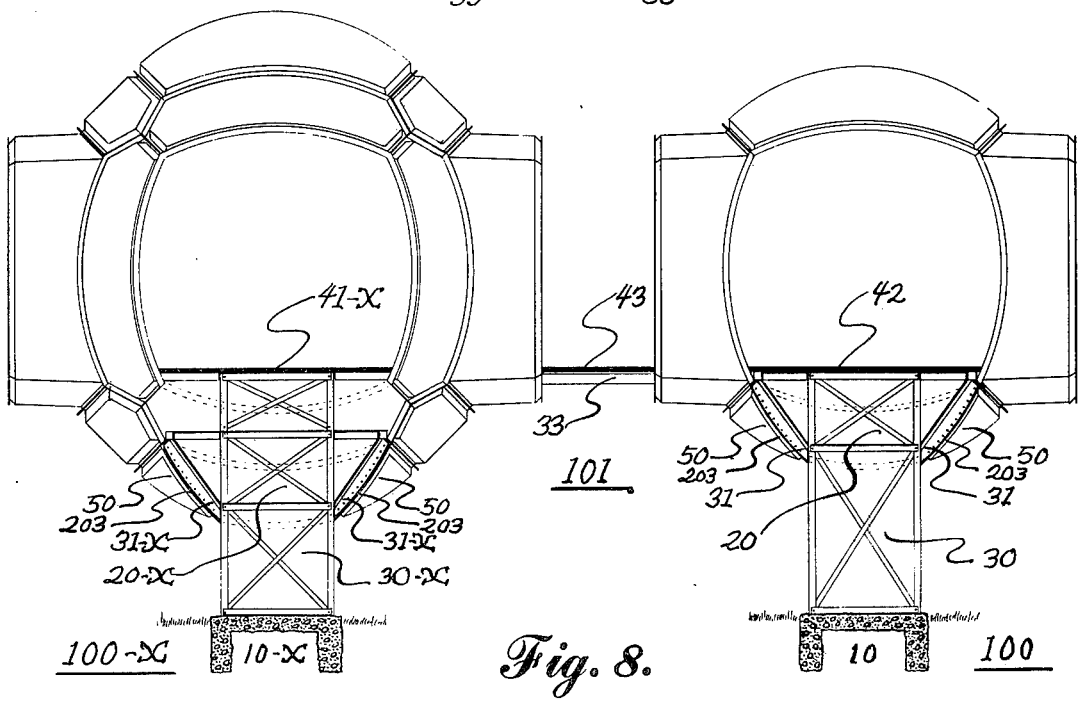
Fig. 8.

MODULAR BUILDING SYSTEM

CROSS REFERENCE TO RELATED APPLICATIONS

This application is a continuation-in-part of my pending Patent Application entitled HABITABLE SYSTEM, filed May 11, 1971, under Ser. No. 142,219 and now abandoned.

SUMMARY OF THE INVENTION

The Modular Building System of my invention comprises individual room or space modules of at least two basic types. The first type, termed Foundation Secured Modules, are secured to suitable foundations. Foundation Secured Modules can be of any size but two sizes are shown, Standard and Expanded. These two sizes suffice for most habitable purposes. The second type of module, termed Bridging Module, structurally spans between and interconnects adjacent Foundation Secured Modules. Bridging Modules may also be of any required size, but only one size is illustrated herein.

Individual modules of either basic type generally function as a single space or room, for example; living room, bathroom, kitchen, etc., but modules can include some interior partitioning as required for compartmentalization, privacy, etc. There is considerable choice in the positioning of such partitioning, which allows an increase or decrease in the overall interior space attributed to any particular module.

Foundation Secured Modules can be supported above suitable foundations by means of a Columnar Structure which can vary in height by as much as 20 feet or more, which commensurately reduces the need to change the natural grade at any particular building site. This Columnar Structure preferably stems up from the foundations and cantilevers outwardly before actually connecting to a module. The Columnar Structure picks up and transfers the module's relatively widespread loadings into relatively simple and concentrated foundations, thereby minimizing the foundation work necessary at any particular building site.

In the Modular Building System of this invention, all components are partially or wholly prefabricated by a variety of conventional and specialized methods which methods which produce accurately matching parts from suitably selected materials, resulting in the production of houses having improved capability to withstand all natural exposures and hazards. The Sections comprising the enclosing shells of the room or space modules are preferably made of a plastic sandwich construction, later described. The forms of these Sections are preferably derived from the geometry of a spherical square, a curvature which improves both structural and production characteristics. These unusual forms can not be produced by traditional construction methods.

This invention advances the state of the construction art by systematizing production of unusual and interesting buildings by successfully integrating the following seemingly irreconcilable essentials:

1. The system is applicable to all likely climates and geographical sites.

2. The system is comprised of very few types of properly conceived, highly standardized and accurately matching components essential for efficient production, transportation and site assembly.

3. The system's relatively few types of components and modifications thereof make up into a full complement of rooms, spaces and compartments which readily accomodate all equipment, furniture and accessories necessary for all kinds of living conditions.

4. The system provides for varying room sizes which can be connected together to form almost any desirable floor plan arrangement.

5. The system incorporates advanced technology which improves and enhances both physical performance and architectural atmosphere.

THE DRAWINGS

The Modular Building System of this invention will now be described in more detail and with particular reference to the following figures.

FIG. 6 is a cutaway elevation view of typical Columnar Structures showing the Floor Support Brackets and Floor Support Rails.

FIG. 7 is a cross-sectional view through a Bridging Module showing the position of Floor Support Rails.

FIG. 8 is another cutaway elevation view of typical Columnar Structures showing Fin Brackets.

DESCRIPTION OF THE PREFERRED EMBODIMENT

Figure 1:
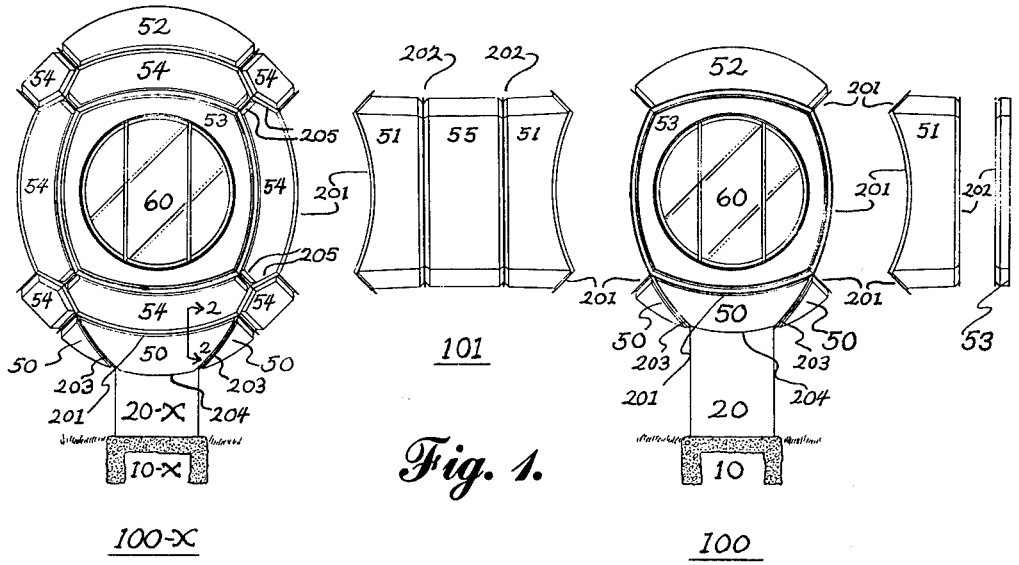
FIG. 1 illustrates, in elevation, the basic modules of my invention, namely an Expanded Foundation Secured Module, a Bridging Module and a Standard Foundation Secured Module. Columnar Structures and typical foundations for the Foundation Secured Modules are also indicated.

FIG. 1 shows in elevation typical room or space modules which comprise the system of my invention. These basic Modules are: a Standard Foundation Secured Module 100, an Expanded Foundation Secured Module 100-X and a Bridging Module 101. The Standard Foundation Secured Module 100 is comprised of Foundations 10, Columnar Structure 20, four Sub Sections 50, one Ceiling Section 52 and as many Bay Sections 51 and Window Sections 53 with Glazing 60 included as required to complete the enclosure. By including twelve Hexagonal Sections 54, an omnidirectionally Expanded Foundation Secured Module 100-X is formed, the Foundations and Column for which are numbered 10-X and 20-X respectively. The Bridging Module 101 shown is comprised of two Bay Sections 51 and one Center Section 55, and this Bridging Module may alternatively be formed with more than one Center Section 55, or with only two Bay Sections 51 directly attached to each other. Bay Sections 51 also serve the purpose of forming useful alcoves for Foundation Secured Modules. In one form of the invention a basic habitation could be comprised of two Foundation Secured Modules 100 interconnected by one Bridging Module 101.

The configurations of the various Sections comprising the enclosing shells of the Foundation Secured Modules and the Bridging Modules are derived from the geometry of a spherical square. Bay Sections 51 and Ceiling Sections 52 have matching spherical square arc edge flanges, denoted 201. The tubular form of Bay Sections 51 and Center Sections 55 is concentric with the aforementioned spherical square arc edges; see FIG. 7. The forms of the spherical trapezoidal Sub Sections 50, the basically planar Window Sections 53 and the cylindrically curved Hexagonal Sections 54 necessarily match and are therefore also determined by the spherical square shaping of adjacent Bay Sections. Center Sections 55, Window Sections 53 and one end of Bay Sections 51 necessarily have matching planar flanges 202. Sub Sections 50 have two common arc edge flanges 203, one arc edge flange 201 and one other edge 204 which butts the Columnar Structure. Hexagonal Sections 54 have four common straight edge flanges 205 and two arc edge flanges 201.

Figure 2:
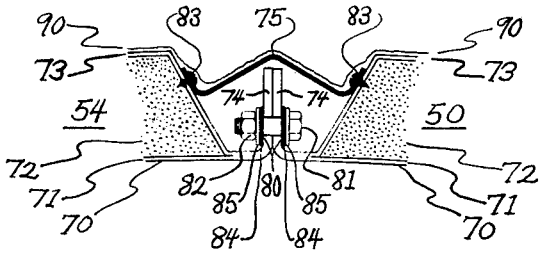
FIG. 2 is a cross-sectional view taken along line 2—2 of FIG. 1, showing a typical interconnection between Sections comprising the enclosing shells of the Modules of this invention.

All Sections mentioned above are preferably of a plastic sandwich construction and are provided with integrally molded edge flanges of the general type shown in FIG. 2. All Sections are scaled for easy handling, transportation and installation. For reference, the largest section, a Bay 51 measures approximately 10 feet × 10 feet × 4 feet and weighs approximately 280 lbs.

Other types of components, sections and modifications are also anticipated within the general scope of the invention.

FIG. 2 shows the details of the plastic sandwich construction of the Sections comprising the enclosing shells of the Modules illustrated in FIG. 1, including the integrally molded flanges by which adjacent Sections are typically bolted together. Such plastic sandwich construction can be prefabricated and has a high strength to weight ratio and also good thermal insulating properties. An optional cement stucco surfacing improves durability and fire resistance.

Typically, the inside surface of a Section is a Polyester Gel Coat 70, of any suitable color, approximately 15 mils thick. This Gel Coat is backed up with approximately 130 mils of a fiberglas reinforced polyester Laminate 71. This in turn is backed up with approximately 3 inches of 2 pound per cubic foot density polyurethane Foam 72, which in turn is backed up by a second 130 mils of a fiberglas reinforced polyester Laminate 73. The two Laminates 71 and 73 converge and become contiguous at the edge flanges of a Section, thereby totally encasing the Foam 72 and forming the integral Flange 74 as illustrated. Adjacent Sections, e.g. Sections 50 and 54 at line 2—2 of FIG. 1 can thereby be suitably fastened together by means of a typical Bolt 81 passing through two matching holes 80 in the pair of matching Flanges 74, a pair of waterproofing neoprene Washers 84 backed up by metal Washers 85 and a Nut 82. A Flashing Strip 75, secured by means of conventional Screws 83, waterproofs the pair of integral standing Flanges 74. An optional Surfacing 90 can be applied either before or after erection of Modules to improve color, texture, fire resistance, durability, etc. The Surfacing 90 may be a cement stucco composition, a pigmented resinous paste, or any other appropriate material.

Figure 3:
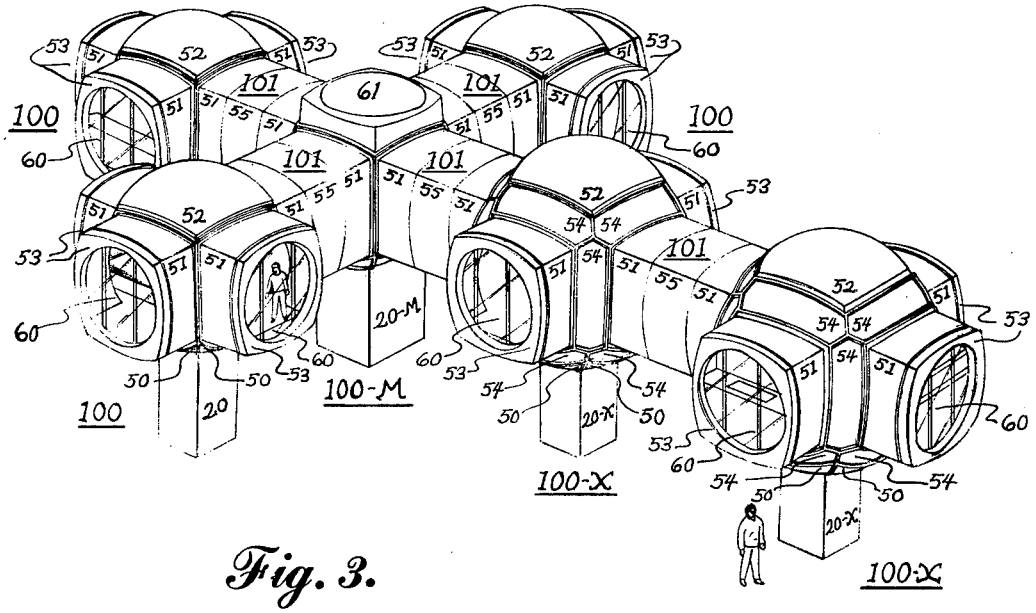
FIG. 3 is a perspective view of a typical arrangement of Modules comprising a habitation.

FIG. 3 shows in perspective a habitable arrangement of three Standard Foundation Secured Modules 100, one Modified Foundation Secured Module 100-M, two Expanded Foundation Secured Modules 100-X and five Bridging Modules 101 which structurally span between and interconnect adjacent Foundation Secured Modules. Columnar Structures 20, 20-M and 20-X support Modules 100, 100-M and 100-X above their respective foundations. Glazing 60 is indicated for Window Sections 53. To indicate human scale, two men are shown, one inside and one outside the habitation.

Figure 4:
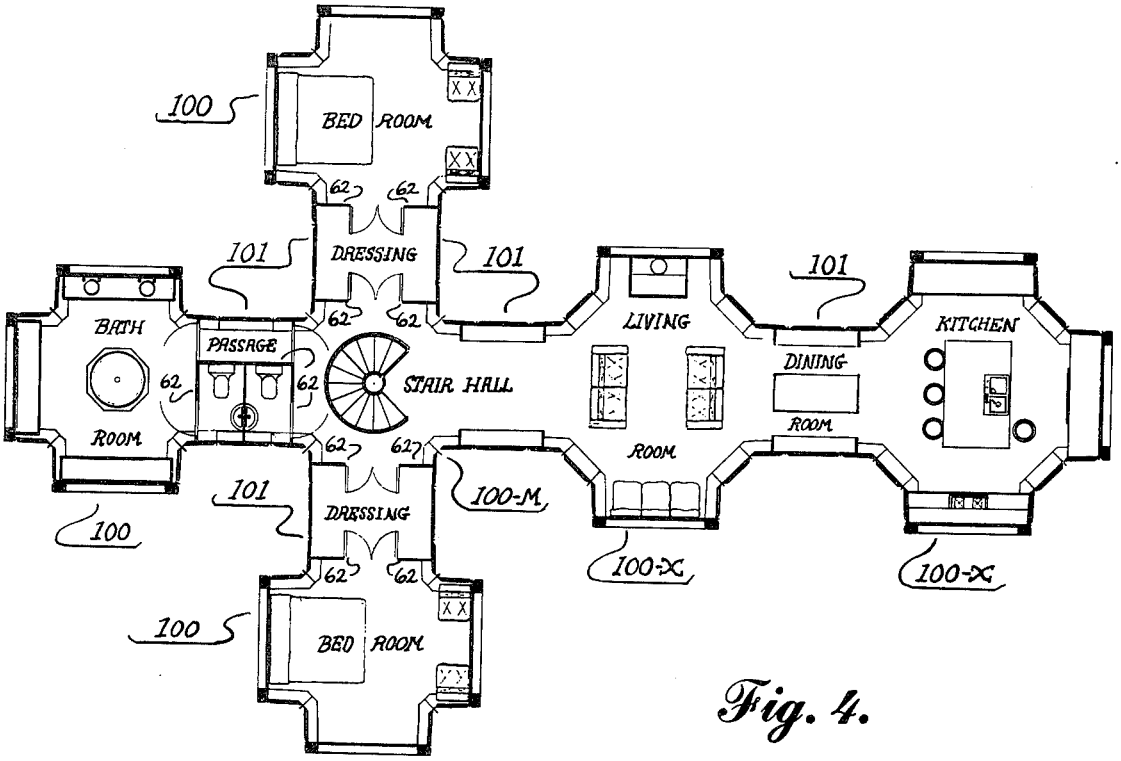
FIG. 4 is a floor plan of the typical habitation shown in FIG. 3.

FIG. 4 shows a furnished floor plan of the arrangement of Modules shown in FIG. 3. Foundation Secured Module 100-M is modified for use as a ground level entrance stairway equipped with a Skylight 61 overhead, see FIG. 3. Module 100-M can be further modified to continue the stairway up to a second floor level of Modules. Many other modifications are implicit within the scope of the invention and are not described herein. All partitions 62 can be non-load bearing, and the positions of such partitions shown are typical.

Figure 5:
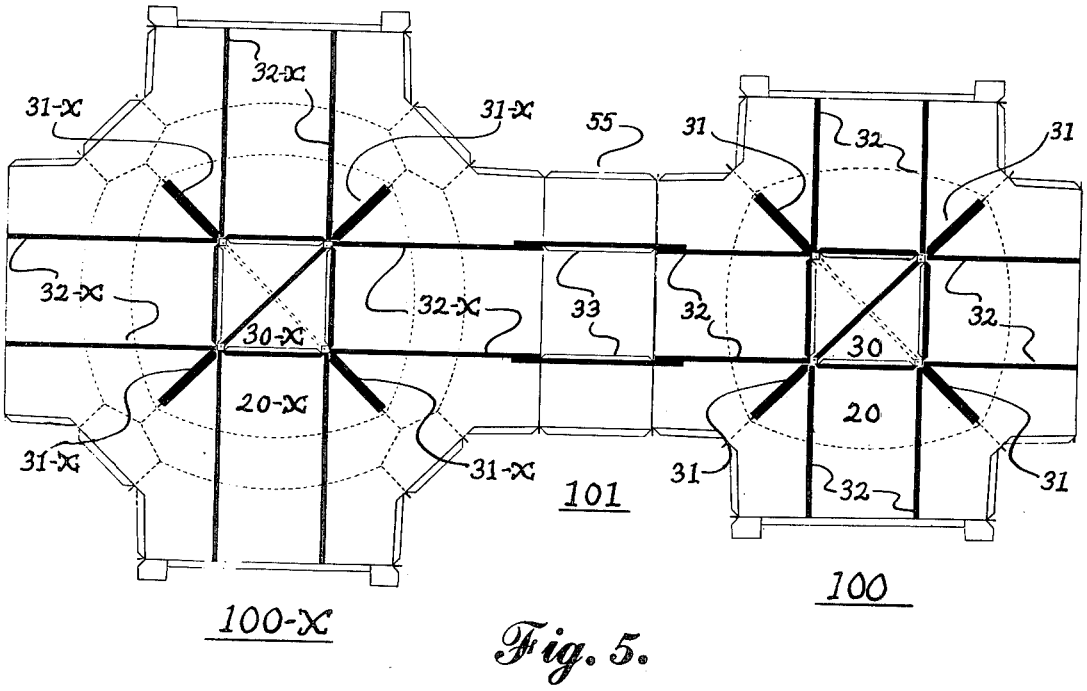
FIG. 5 is a plan view of typical Columnar Structures showing the position of Fin Brackets, Floor Support Brackets and Floor Support Rails.

FIG. 5 shows a plan view of two typical Columnar Structures 20 and 20-X required to support Foundation Secured Modules 100 and 100-X and their respective floors above suitable foundations. These structures are preferably frameworks comprised of hot rolled structural steel. Shown are two sets of four Fin Brackets 31 and 31-X and two sets of eight Floor Support Brackets 32 and 32-X, all of which cantilever out from the respective four corner angles of their respective Central Columns 30 and 30-X. In the preferred configuration the Central Columns of the Columnar Structures have a cross section of approximately 4feet × 4 feet with an overall height dependent on grade variations and required floor levels. A pair of Floor Support Rails 33 preferably interconnects the floor support brackets of adjacent Columnar Structures in order to support a floor in a Center Section 55 of a Bridging Module 101. Refer to FIGS. 6, 7 and 8 for other views.

FIG. 6 is a cutaway elevation view of the FIG. 5 Modules. Columnar Structures 20 and 20-X are shown suitably secured to foundations 10 and 10-X respectively. Floor Support Brackets 32 and 32-X are shown, as are Floor Support Rails 33. Floors 42, 42-X and 43, preferably of plywood, are suitably secured to their respective Floor Support Brackets. The outlines of the enclosing shells of Modules 100, 100-X and 101 are shown. Note that there is an insulated space enclosed both above and below the floor level. This space below the floor, including optionally enclosed space within the Central Columns, is useful for storage, mechanical equipment, ducts, electrical wiring, plumbing pipes, etc.

FIG. 7 shows a cross-sectional view through a Bridging Module 101, in particular, an end view through the tubular cross section of a Center Section 55 and a Bay Section 51. Note cross section of Floor Support Brackets 33 underneath Floor 43 and flange bolt holes 80 for typical connection of Sections as seen in FIG. 2.

FIG. 8 is another cutaway elevation view of the FIG. 5 Foundation Secured Modules 100 and 100-X with some Sections removed for comparison of their different Columnar Structures 20 and 20-X, and featuring Fin Brackets 31 and 31-X. These Fin Brackets are the means by which the enclosing shells of the individual Modules are attached to their Columnar Structures 20 and 20-X respectively. Two pairs of Fin Brackets 31 and 31-X can be seen cantilevering out diagonally in the vertical plane from the four corner angles of the framed Central Columns 30 and 30-X of their respective Columnar Structures 20 and 20-X. (Refer to FIG. 5.) Fin Brackets insert between the matching plastic flanges 203 of adjacent Sub Sections 50 and are bolted through, typically using some 14 bolts per Fin connection. The Fin Brackets can also contribute to floor support. It should be noted here that the enclosing shells of Bridging Modules 101 bolt directly to and are primarily supported by the enclosing shells of adjacent Foundation Secured Modules 100 or 100-X. Columnar Structures 20 and 20-X are shown suitably secured to appropriate Foundations 10 and 10-X respectively, and these foundations are necessarily tailored to individual site conditions.

The foregoing detailed description is cited for clarity of understanding only, and no undue limitations to the scope of my invention should be inferred therefrom. Many variations, adaptations and modifications will be obvious to anyone skilled in the art.

I claim:

1. A modular building system which comprises:

at least two individual room-sized space enclosing modules individually secured to foundations;

structural means for supporting each of said individual foundation secured room-sized modules above their foundations;

at least one non-collapsible rigid, clearspan room-sized space-enclosing module which structurally bridges between, and is rigidly interconnected to, at least two of said foundation secured individual room-sized modules, each of said clearspan modules being completely supported by at least two of the said foundation secured individual room-sized modules and by said structural means therefor, each of said individual room-sized space-enclosing modules being defined by a rigid space-enclosing shell, said rigid shell of each of said individual room-sized modules comprising a plurality of prefabricated molded plastic sections, the shapes of said sections being derived from the geometry of a spherical square;

said structural means for supporting each of said individual foundation secured room-sized modules above their foundations, extending upwardly and outwardly with respect to their foundations and further extending through said at least one rigid clearspan module; and a floor supported upon said structural means which defines a space both above and below said floor within the rigid shell of the individual room-sized modules.

2. The modular building system of claim 1 wherein each individual room-sized module comprises a plurality of prefabricated molded plastic sections, at least some of said plastic sections having an integrally formed flange for attachment to an integrally formed flange of another of said plastic sections.

3. A modular building system which comprises:

at least two individual room-sized space-enclosing modules individually secured to foundations;

structural means for supporting each of said individual foundation secured room-sized modules above their foundations;

at least one rigid, non-collapsible, clearspan, space-enclosing, room-sized module which structurally bridges between and is rigidly interconnected to at least two of said foundation secured individual room-sized modules, each of said clearspan modules being completely supported by at least two of the said foundation secured individual room-sized modules and by said structural means therefor;

each of said individual room-sized modules being defined by a rigid space-enclosing shell, said rigid shell of each of said individual room-sized modules comprising a plurality of prefabricated molded plastic sections, at least some of said plastic sections having an integrally formed flange for attachment to an integrally formed flange of another of said plastic sections;

said structural means for supporting each of said individual foundation secured room-sized modules above their foundations extending upwardly and outwardly with respect to their foundations and further extending through said at least one clearspan module; and said structural means also supporting a floor which defines a space both above and below said floor within the rigid shell of the said individual room-sized modules.

4. The modular building system of claim 3 wherein the shapes of some of said prefabricated molded plastic sections and said clearspan room-sized module are derived from the geometry of a spherical square.

5. A modular building system which comprises:

at least two individual room-sized modules, each individually secured to foundations and each comprising a rigid space-enclosing shell composed of a plurality of prefabricated sections;

structural means for supporting each of said individual room-sized modules above said foundations, said structural means extending upwardly and outwardly with respect to said foundations;

at least one clearspan, non-collapsible, rigid room-sized module structurally bridging between the rigidly interconnected to at least two of the said foundation secured individual room-sized modules, each of said clearspan modules being completely supported by at least two of the said foundation secured individual room-sized modules and by said structural means therefor;

and each of said clearspan modules comprising a rigid space-enclosing shell composed of a plurality of prefabricated sections.

6. The modular building system of claim 5 wherein at least several of said plurality of prefabricated sections are derived from the geometry of a spherical square.

7. The modular building system of claim 5 wherein at least some of said prefabricated sections are primarily made of molded plastic.

8. The modular building system of claim 5 wherein at least some of said plurality of prefabricated sections are derived from the geometry of a spherical square, and are made primarily of molded plastic.

9. The modular building system of claim 5 wherein some of said prefabricated sections have an integrally formed flange for attachment to an integrally formed flange of another of said prefabricated sections.

10. The modular building system of claim 5 wherein said structural means for supporting said individual room-sized modules above their foundations also supports a floor which defines a space both above and below said floor within the rigid shell of individual room-sized modules.

11. The modular building system of claim 5 wherein said structural means for supporting each of said individual room-sized modules above their foundations, also supports a floor thereupon.

* * * * *

UNITED STATES PATENT OFFICE

CERTIFICATE OF CORRECTION

PATENT NO. : 3,955,328

DATED : May 11, 1976

INVENTOR(S) : JEFFREY LINDSAY

It is certified that error appears in the above-identified patent and that said Letters Patent are hereby corrected as shown below:

Title page, Item [76] should read

--430 Amapola Lane--

Column 1, line 47, delete "methods which"; and

Column 6, line 35 (Claim 5): delete "the" and substitute --and--.

Signed and Sealed this

Twelfth Day of October 1976

[SEAL]

*Attest:*

RUTH C. MASON
*Attesting Officer*

C. MARSHALL DANN
*Commissioner of Patents and Trademarks*